United States Patent [19]

Grohe

[11] 4,266,730

[45] May 12, 1981

[54] SPRAY DEVICE

[75] Inventor: Klaus Grohe, Schiltach, Fed. Rep. of Germany

[73] Assignee: Hans Grohe GmbH & Co. KG, Schiltach, Fed. Rep. of Germany

[21] Appl. No.: 35,565

[22] Filed: May 3, 1979

[30] Foreign Application Priority Data

May 5, 1978 [DE] Fed. Rep. of Germany ..... 2819623

[51] Int. Cl.[3] ..... B05B 1/18; B05B 15/08

[52] U.S. Cl. ..... 239/587; 285/184

[58] Field of Search ..... 137/270; 285/184; 239/587

[56] References Cited

U.S. PATENT DOCUMENTS

| | | | |
|---|---|---|---|
| 128,303 | 6/1872 | Hammond | 285/184 |
| 185,236 | 12/1876 | Hoskin | 239/587 |
| 776,971 | 12/1904 | Walsh | 285/184 |

FOREIGN PATENT DOCUMENTS

| | | | |
|---|---|---|---|
| 458712 | 3/1974 | Australia | 239/587 |
| 1038391 | 9/1953 | France | 285/184 |
| 1186679 | 4/1970 | United Kingdom | 239/587 |

*Primary Examiner*—Andres Kashnikow

*Attorney, Agent, or Firm*—Steele, Gould & Fried

[57] ABSTRACT

A spray device having an attachment member for connecting the device to a stationary water supply and a spray head for discharging the water. The spray device includes at least two wedge-shaped connecting members, each having at least one wedge surface, the wedge-shaped connecting members being rotatably connected to one another along a plane, to the wedge surfaces of adjacent connecting members. One of the wedge-shaped members is rotatably connected to the attachment member. Another wedge-shaped member has the spray head mounted thereon. The attachment member and the wedge-shaped members provide communicating water passages between the stationary water supply and the spray head, whereby the spray head may be tiltably adjusted toward and away from the attachment.

22 Claims, 2 Drawing Figures

SPRAY DEVICE

BACKGROUND OF THE INVENTION

The invention relates to a spray device with an attachment member for attachment to a stationary water supply and a spray head rotatably connected thereto and tiltable towards the attachment member.

In known spray heads of this kind, the spray head is connected to the attachment member, which is intended to be attached to a stationary water supply, via a hollow ball-and-socket joint, and generally the attachment member comprises, at its end facing the shower head, a projection in the form of a hollow ball which is enclosed by the walls of the hollow spray head so as to hold it in place. Spray devices of this kind have a number of disadvantages all of which are due to the construction itself. These disadvantages include the relatively expensive and complex manufacture of spray devices of this kind. Another disadvantage is that assembly and cleaning cannot usually be carried out by the layman, particularly as an annular gasket fitting round the hollow spherical projection of the attachment member has to be provided inside the spray head and has to be secured against axial movement. A further disadvantage is that the spray heads in spray devices of this kind can only be tilted to a maximum of 30° and they are relatively tall in construction, which means that they are not particularly suitable for use as wall-mounted showers. A final disadvantage is the fact that, in these known devices, the cross section of flow alters as the spray head is pivoted, when the maximum pivot angle is used.

BRIEF SUMMARY OF THE INVENTION

The object of the invention is to provide a spray device of the kind described hereinbefore which is cheaper and less complicated to manufacture and wherein the spray head can also be assembled more easily by the layman, and which is characterised by a greater ability to pivot and a lesser height, and finally wherein the cross section of flow is not affected by the pivoting of the spray head.

According to the invention, this problem is solved by a spray device of the kind indicated hereinbefore, wherein at least two wedge-shaped connecting members are provided between the spray head and the attachment member, all the connecting members are constructed so as to be rotatable relative to the attachment member and are connected rotatably to one another in the plane of the wedge surfaces common to the adjacent connecting members and comprise water passages connected to one another. With a spray device of this kind, there is no need for the relatively complicated construction of the hollow spherical attachment projection and the mounting and sealing thereof in the spray head, and on the one hand this reduces the cost and on the other hand it means that the spray device a according to the invention can be made much lower in construction. The wedge-shaped construction of the connecting members, their common water passage and their ability to rotate relative to one another means that the spray head associated with one of these connecting members is capable of tilting relative to the axis of the attachment member in every direction to a hitherto unattainable degree without affecting the cross section of flow of the spray device, even when it is inclined at the maximum angle.

In a preferred embodiment of the spray device according to the invention, two wedge-shaped connecting members are connected to each other via a centrally mounted hollow connecting member which is arranged so as to extend perpendicularly to the wedge surface plane common to the two connecting members, this other connecting member preferably consisting of two substantially tubular components which can be screwed together, thus making assembly and mounting considerably simpler and easier.

The spray head of the spray device according to the invention and/or the wedge-shaped connecting members provided between it and the attachment member preferably have external profiling to facilitate their rotation. Handling of the spray device according to the invention can be further simplified by providing a handle to facilitate rotation, on the spray head and/or on the wedge-shaped connecting members provided between the spray head and attachment member.

Preferably, the wedge-shaped connecting members of the spray device according to the invention are each constructed so as to be rotatable through an angle of more than 180°, preferably more than 360°. The wedge surfaces of the individual wedge-shaped connecting members advantageously enclose an angle of between 10° and 45°, preferably between 15° and 30°, so that in the case of two wedge-shaped members the spray head can be tilted through an angle of at least 20° and at most 90°, preferably at least 30° and at most 60°, relative to the axis of the attachment member, and indeed can be so tilted continuously in every direction. The more wedge-shaped members are used, the smaller the wedge angles used. As a rule, two wedge-shaped members are sufficient.

The wedge surfaces of the wedge-shaped connecting members preferably all enclose the same angle. The spray head of the spray device according to the invention and the wedge-shaped connecting members provided between it and the attachment member preferably have substantially circular cross sections of from 50 to 60, preferably 55 mm. The spray head and the connecting members provided between it and the attachment member, these connecting members preferably being substantially in the form of torus segments, can thus be operated manually with ease, particularly if they have the external profiling mentioned above and/or a laterally projecting handle.

The wedge-shaped connecting members provided between the spray head and the attachment member are preferably hollow in construction. The spray head and/or the wedge-shaped connecting members associated with it are preferably made of matt chrome-plated plastics, so that the weight and manufacturing costs of the spray device according to the invention can be kept relatively low, in comparison with the spray devices known hitherto.

The spray head is fixed to the wedge-shaped connecting member associated therewith, preferably on the wedge surface of the connecting member which is remote from the adjacent wedge-shaped connecting member, in releasable manner, e.g. by screwing, so that it can be removed and its inside cleaned. The wedge-shaped connecting members may be relatively flat in construction, without affecting the ability of the spray head of the spray device according to the invention to pivot. The average wedge height of the wedge-shaped connecting members is preferably from 14 to 20 mm.

BRIEF DESCRIPTION OF THE DRAWINGS

Further details of the invention will become apparent from the claims and the following description of a preferred embodiment, in conjunction with the drawings which show schematic sections through this embodiment. The figures differ from each other essentially only in the fact that the connecting members shown are in different positions.

DETAILED DESCRIPTION OF THE PREFERRED EMBODIMENTS

Figure 1:
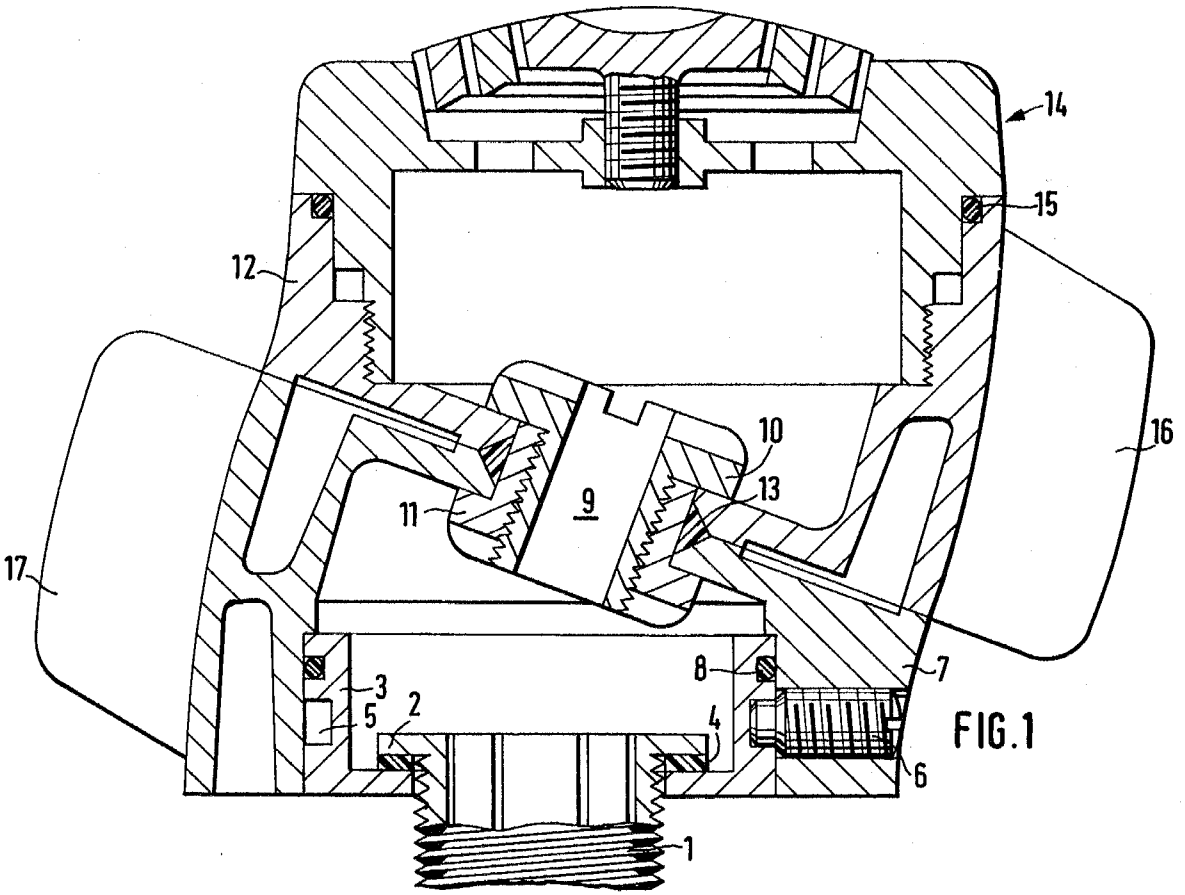
FIG. 1 shows a spray device according to the invention, with the spray head tilted.

The spray device according to the invention comprises an attachment member 1 which is adapted for attachment to a water supply (not shown in the drawings), e.g. a pipe connection projecting from a wall or ceiling. In the embodiment shown in the drawings, this substantially tubular attachment member 1 is provided with an external thread and an internal profile intended for the engagement of a box spanner. At its end remote from the attachment end, this attachment member 1 comprises an outwardly projecting edge 2 which projects inside a substantially cylindrical annular member 3 and is sealed against the latter by means of a ring gasket 4. The cylindrical outer wall of the annular member 3 has an annular groove 5 extending round it into which the front end of a fixing screw 6 projects, this screw 6 being screwed into a lateral recess of a hollow wedge-shaped connecting member 7 engaging over the annular member 3, whilst the connecting member 7 is sealed against the annular member 3 via an O-shaped ring gasket 8, so that the wedge-shaped connecting member 7 is secured in fluidtight manner so as to be rotatable about the annular member 3 and prevented from axial movement.

The wedge-shaped connecting member 7 is connected, via a central hollow connecting member 9 consisting of two halves 10, 11 which can be screwed together, to a second connecting member 12, which is again hollow, cup-shaped and wedge-shaped, in rotatable and—via a ring gasket 13—fluidtight manner, whilst the connecting member 9 is arranged so as to extend perpendicularly to the wedge surface plane common to the two connecting members 7, 12. At its end remote from the first wedge-shaped connecting member 7, the second wedge-shaped connecting member 12 is screwed to a spray head 14 which is sealed against the second connecting member 12 via a ring gasket 15. The spray head 14 and the wedge-shaped connecting members 7, 12 arranged between it and the attachment member 1 are all substantially circular in cross section, whilst the two wedge-shaped connecting members 7, 12 are substantially in the form of torus segments. The spray head 14 and/or the wedge-shaped connecting members 7, 12 provided between it and the attachment member 1 consist of matt chrome-plated plastics, especially polysulphone.

To facilitate their pivoting—and hence that of the spray head 14—the two wedge-shaped connecting members 7, 12 each have axially extending handles 16, 17 integral therewith; in the embodiment shown, these handles are provided at the point where the outer walls of the connecting members are highest. However, the handles could also be provided at any other point on the outer walls of the connecting members, but would then have to be correspondingly smaller, so as not to affect the pivoting of the spray head screwed to the connecting member 12.

The first wedge-shaped connecting member 7 is rotatable in any direction, at any desired angle, about the annular member 3 passing therethrough. The same is also true of the second wedge-shaped connecting member 12 which is connected rotatably and in fluidtight manner to the first wedge-shaped connecting member 7, with the result that the two connecting members 7, 12 can assume any desired position relative to each other, in addition to the two positions shown in the drawings, and, owing to the wedge-shaped construction of the connecting members 7, 12, this in turn means that the spray head 14 can be pivoted all round, the pivot angle of the spray head 14 being dependent on the wedge angles of the wedge-shaped connecting members 7, 12 and the position taken up by these wedge-shaped members relative to each other. If, for example, the wedge surfaces of the two wedge-shaped connecting members 7, 12 enclose a wedge angle of 30°, it follows that the angle of inclination of the spray head 14 can be varied from 0° to a maximum of 60° by rotating the wedge-shaped connecting members 7, 12; an even greater maximum angle of inclination of the spray head can be obtained by using wedge-shaped connecting members with greater wedge angles and/or by the cooperation of more than two wedge-shaped connecting members. In the embodiment shown in the drawings, the wedge angles of the two connecting members 7, 12 are both 20°, which means that the maximum angle of inclination of the spray head in this embodiment is 40°.

Figure 2:
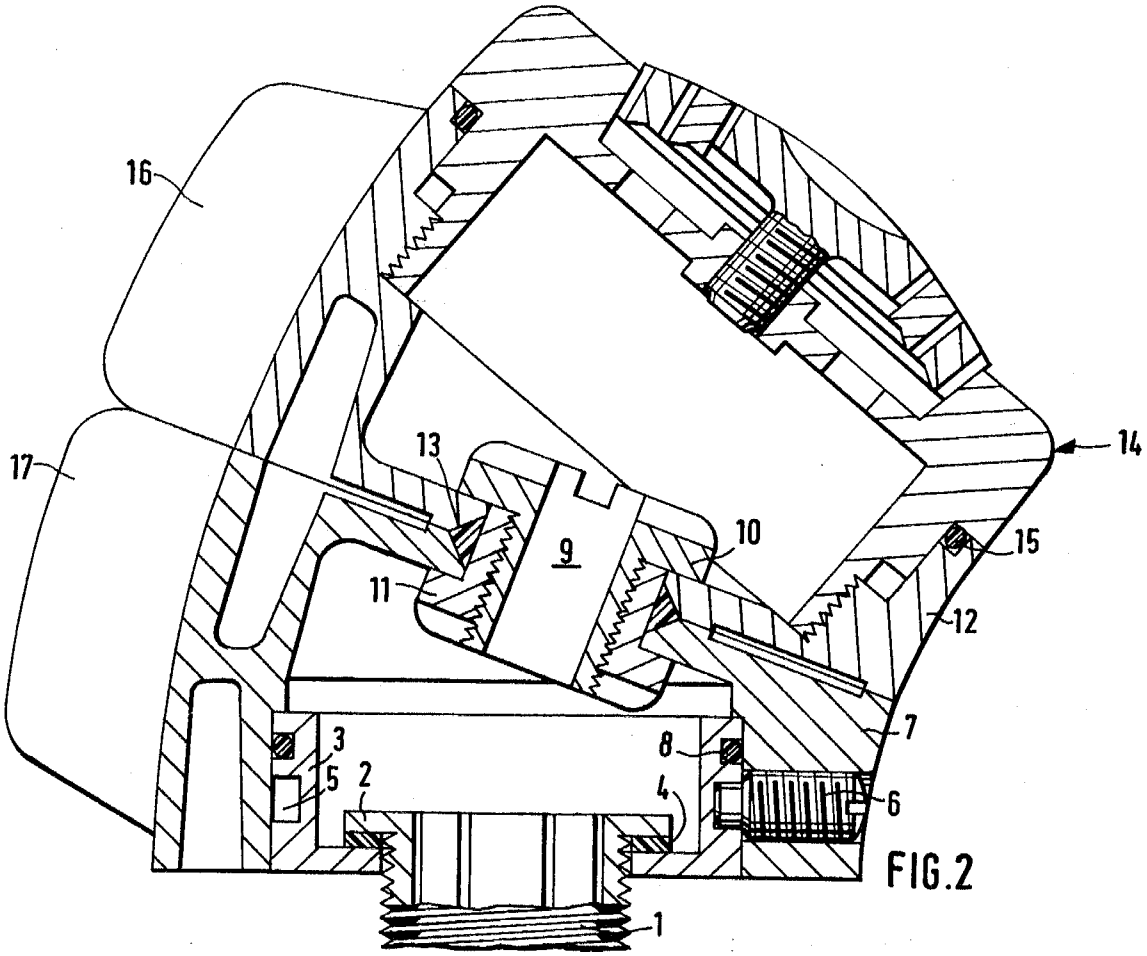
FIG. 2 shows the spray device of FIG. 1, with the spray head in the non-tilted position.

In comparison with the known spray devices of the kind mentioned at the beginning, the spray device according to the invention is characterised by a relatively low constructional height and also by relatively large maximum angle of inclination of the spray head; this means that it is suitable for use anywhere where space is limited and where it is desirable for the spray head to be pivoted at large angles in an easily adjustable manner, i.e. in particular in shower cubicles with laterally mounted showers, in which lateral showers are mounted on the two opposite walls and hence the height of the showers is doubly important. As can be seen from FIGS. 1 and 2, there is still enough free space in the front wedge-shaped member 14, despite its low height, to receive a turbine, for example, for producing a massage jet, and the switching mechanism required for this purpose.

The invention is not limited to the embodiments described and represented hereinbefore and various modifications can be made thereto without passing beyond the scope of the invention.

I claim:

1. A spray device having an attachment member for connecting the device to a stationary water supply and a spray head for discharging the water, comprising:

at least two wedge-shaped connecting members, each having at least one wedge surface, the wedge-shaped connecting members being rotatably connected to one another along a plane, to the wedge surfaces of adjacent connecting members;

one of the wedge-shaped members being rotatably connected to the attachment member;

another of the wedge-shaped members having the spray head mounted thereon; and, the attachment member and the wedge-shaped members providing communicating water passages between the stationary water supply and the spray head, whereby the spray head may be tiltably adjusted toward and away from the attachment member.

2. A spray device according to claim 1, wherein at least one of the spray head and the wedge-shaped connecting members have external profiling which facilitates manual rotation.

3. A spray device according to claim 1, wherein at least one of the spray head and the wedge-shaped connecting members have a handle to facilitiate rotation.

4. A spray device according to claim 1, wherein the wedge-shaped connecting members are constructed so as to be rotatable by more than 180° about axes perpendicular to the wedge surfaces.

5. A spray device according to claim 4, wherein the wedge-shaped connecting members are constructed so as to be rotatable by more than 360°.

6. A spray device according to claim 1, wherein the wedge surfaces of the wedge-shaped connecting members enclose an angle of from 10° to 45°.

7. A spray device according to claim 6, wherein the wedge-surfaces of the wedge-shaped connecting members enclose an angle of from 15° to 30°.

8. A spray device according to claim 1, wherein the wedge surfaces of the wedge-shaped connecting members all enclose the same angles.

9. A spray device according to claim 8, further comprising a centrally disposed hollow connecting member for rotatably connecting the wedge-shaped members, which is arranged so as to extend perpendicularly to the wedge surface plane common to the two connecting members.

10. A spray device according to claim 9, wherein the hollow connecting member comprises two threadably engageable parts.

11. A spray device according to claim 1, wherein the sum of the individual wedge angles of the connecting members is from 30° to 90°.

12. A spray device according to claim 1, wherein the spray head, the wedge-shaped connecting members and the attachment member are substantially circular in cross section.

13. A spray device according to claim 12, wherein the cross sections each have a diameter of 50 to 60 mm.

14. A spray device according to claim 13, wherein the diameter of each cross section is approximately 55 mm.

15. A spray device according to claim 1, wherein the wedge-shaped connecting members are substantially in the form of torus segments.

16. A spray device according to claim 1, wherein the wedged-shaped connecting members are hollow.

17. A spray device according to claim 1, wherein at least one of the spray head, the wedge-shaped connecting members and the attachment member are formed of matt chrome-plated plastics.

18. A spray device according to claim 17, wherein the matt chrome-plated plastic is polysulphone.

19. A spray device according to claim 1, wherein the spray head is releasaby and threadably connected to the wedge-shaped connecting member associated therewith, on the wedge surface remote from the other wedge-shaped connecting member, and is rotatable therewith.

20. A spray device according to claim 1, wherein the average wedge height of the wedge-shaped connecting members is within the range of from 14 to 20 mm.

21. A spray device according to claim 20, wherein the average wedge height is within the range of from 16 to 18 mm.

22. A spray device according to claim 1, constructed as a laterally mounted shower unit with two substantially wedge-shaped connecting members.

* * * * *

UNITED STATES PATENT AND TRADEMARK OFFICE

CERTIFICATE OF CORRECTION

PATENT NO. : 4,266,730

DATED : May 12, 1981

INVENTOR(S) : Klaus Grohe

It is certified that error appears in the above-identified patent and that said Letters Patent are hereby corrected as shown below:

At col. 1, line 59, after "device" delete "a".

At col. 6, line 24 (claim 19, line 2), delete "releasaby" and insert --releasably--.

Signed and Sealed this

*Eleventh* Day of *August 1981*

[SEAL]

*Attest:*

GERALD J. MOSSINGHOFF

*Attesting Officer*

*Commissioner of Patents and Trademarks*